US011220412B2

(12) United States Patent
Peuker et al.

(10) Patent No.: US 11,220,412 B2
(45) Date of Patent: Jan. 11, 2022

(54) YARN DEFLECTION UNIT

(71) Applicant: Saurer Intelligent Technology AG, Arbon (CH)

(72) Inventors: Heinz-Josef Peuker, Wegberg (DE); Philipp Schiffers, Erkelenz (DE); Joachim Sobkowiak, Mönchengladbach (DE)

(73) Assignee: Saurer Intelligent Technology AG, Arbon (CH)

( * ) Notice: Subject to any disclaimer, the term of this patent is extended or adjusted under 35 U.S.C. 154(b) by 62 days.

(21) Appl. No.: 16/455,677

(22) Filed: Jun. 27, 2019

(65) Prior Publication Data

US 2020/0002120 A1 Jan. 2, 2020

(30) Foreign Application Priority Data

Jun. 28, 2018 (DE) ..... 10 2018 115 601.4

(51) Int. Cl.
*B65H 59/12* (2006.01)
*B65H 57/14* (2006.01)
*B65H 57/04* (2006.01)

(52) U.S. Cl.
CPC ..... *B65H 59/12* (2013.01); *B65H 57/04* (2013.01); *B65H 57/14* (2013.01); *B65H 2301/31124* (2013.01); *B65H 2301/3411* (2013.01); *B65H 2404/1313* (2013.01)

(58) Field of Classification Search
CPC ..... B65H 51/02; B65H 51/04; B65H 51/06; B65H 57/04; B65H 57/14; B65H 59/12
See application file for complete search history.

(56) References Cited

U.S. PATENT DOCUMENTS 244,976 A * 8/1881 Bilby, Jr. ..... F16H 55/50 474/177
820,658 A * 5/1906 Merriman ..... G11B 15/605 242/615.2
2,762,606 A * 9/1956 Morse ..... H02G 1/08 254/393
2,946,559 A * 7/1960 Pickett ..... B66D 3/046 254/134.3 PA
4,070,976 A * 1/1978 Taketomi ..... B65H 57/14 112/241
4,709,918 A * 12/1987 Grinblat ..... A63B 21/012 482/118
4,924,554 A * 5/1990 Stolarski ..... B65H 54/86 19/0.6
5,038,990 A * 8/1991 LeCompte ..... B65H 51/16 226/1

(Continued)

FOREIGN PATENT DOCUMENTS

DE 102009021066 A1 11/2010
DE 102017115939 A1 1/2019

*Primary Examiner* — Shaun R Hurley
(74) *Attorney, Agent, or Firm* — Nelson Mullins Riley & Scarborough LLP

(57) ABSTRACT

A yarn deflection unit for a textile machine, having a housing comprising a curved wall section for forming a radially outer wall section of a curved yarn deflection channel. The solution proposed by the invention is distinguished in that the curved wall section has a yarn guiding groove extending along the curvature for receiving and guiding a yarn.

16 Claims, 5 Drawing Sheets

(56) References Cited

U.S. PATENT DOCUMENTS

| | | | | |
|---|---|---|---|---|
| 6,148,598 | A * | 11/2000 | Gabalda | B65H 51/04 28/240 |
| 6,386,516 | B1 * | 5/2002 | Lenders | B66D 3/046 254/393 |
| 7,517,304 | B1 * | 4/2009 | Swanson | A63B 21/00 482/100 |
| 10,161,488 | B1 * | 12/2018 | Meyer | F16H 55/36 |
| 10,856,537 | B1 * | 12/2020 | Velardi | A01K 87/04 |
| 2002/0056266 | A1 * | 5/2002 | Jaschke | D02G 1/0266 57/289 |
| 2017/0341900 | A1 * | 11/2017 | Sherril | B65H 51/10 |
| 2019/0152737 | A1 * | 5/2019 | Hunt | B65H 57/14 |

* cited by examiner

YARN DEFLECTION UNIT

CROSS-REFERENCE TO RELATED APPLICATION

This application claims priority from German National Patent Application No. 10 2018 115 601.4, filed Jun. 28, 2018, entitled "Yarn Deflection Unit", the entire contents of which are incorporated herein by reference.

FIELD OF THE INVENTION

The present invention relates to a yarn deflection unit for a textile machine, the yarn deflection unit having a housing, which comprises a curved wall section for forming a radially outer wall section of a curved yarn deflection channel.

BACKGROUND OF THE INVENTION

Yarn deflection units for deflecting a running yarn are well known in many designs in the field of textile machines. Such a yarn deflection unit usually interacts with a yarn deflection roller, by means of which the yarn is deflected from a first direction, from which the yarn hits the yarn deflection roller, into a second direction different from the first direction, in which second direction the yarn leaves the yarn deflection roller. Such a yarn deflection unit is known, for example, from German Patent Publication DE 10 2017 115 939 A1. Furthermore, common yarn deflection rollers for textile machines are known, for example, from German Patent Publication DE 10 2009 021 066 A1.

A problem of yarn deflection devices of prior art is that the yarn deflection can be accomplished without disadvantageous effects on the yarn handling only for a deflection angle included by the first and second directions of 90° or greater. For yarn deflections with a deflection angle of less than 90°, several yarn deflection units are usually connected in series in the yarn running direction, and therefore corresponding installation space must be provided.

Furthermore, in the case of air-assisted yarn deflection units, which are known for example from German Patent Publication DE 10 2017 115 939 A1 cited above and in which the yarn or the yarn end is transported in a yarn deflection channel with accompanying air, the further problem of undefined turbulence as a result of back pressure arises for deflection angles of less than 90°, the handling of the yarn or yarn end to be transported consequently no longer being controllable and reproducible.

SUMMARY OF THE INVENTION

The problem addressed by the present invention is that of further developing the yarn deflection unit already known in such a way that, in particular, space-saving yarn deflection is enabled for deflection angles of less than 90°, together with improved yarn handling.

This problem is solved by a yarn deflection unit for a textile machine, which yarn deflection unit has a housing comprising a curved wall section for forming a radially outer or outside wall section of a curved yarn deflection channel. The expressions "yarn" and "thread" may be used interchangeably in the context of the present invention. The expressions "curved" and "a curved course" refer to embodiments which, along the course direction between an initial section and an end section, deviate from a straight course. The curved embodiment is preferably curvilinear, more preferably circular-arc-shaped. "Curvilinear" also includes embodiments which, in the course direction between the initial section and the end section, are formed by a plurality of straight or circular-arc-shaped sections arranged one after the other, which, in their entirety along the arrangement direction, form a curved course deviating from a straight course.

The proposed yarn deflection unit is distinguished from the prior art by the fact that the curved wall section has a yarn guiding groove extending along the curvature, for receiving and guiding a yarn. The yarn guiding groove is preferably open opposite the radially outer direction. In other words, the yarn guiding groove is arranged on a wall inner side of the curved wall section, which wall inner side bounds the yarn deflection channel to be formed, and the yarn guiding groove is open in a direction pointing away from the wall inner side. Thus, a yarn guided into the yarn deflection channel partly bounded by the curved wall section can be transferred into the yarn guiding groove thus formed radially outside and can be deflected in a defined manner by means of the yarn guiding groove as a result of the predefined curvature. The term "yarn guiding groove" means a cross-sectional shape that is arranged in a sectional plane extending transversely to a direction of curvature and that is open on one side and that is suitable for receiving and guiding a yarn.

The design of a yarn guiding groove has proven advantageous for controllable and reproducible yarn handling of the yarn to be deflected. The yarn guiding groove enables controlled guidance of the yarn in the course of the deflection, whereby uncontrolled yarn movement within the yarn deflection channel can be suppressed.

The yarn deflection unit is preferably designed for accompaniment of the yarn in the yarn guiding groove by means of an air flow, which assists in the yarn transport. For this purpose, the housing of the yarn deflection unit is preferably provided with a wall, which at least partially peripherally surrounds the yarn guiding groove and the yarn deflection channel and guides the air flow along the yarn guiding groove and along the yarn deflection channel and comprises the curved wall section; by means of this wall, a defined air flow following the curved wall section for accompanying and transporting the yarn can be established and set at least within the yarn guiding groove and the yarn deflection channel. The wall preferably has at least one air flow passage that communicates with the surroundings of the wall, via which air flow passage a defined air flow portion can be exchanged between the yarn deflection channel or the yarn guiding groove and the surroundings. Furthermore, the at least one air flow passage preferably interacts with a control device for automatically and/or manually controlling or setting the air flow rate that can be exchanged via the air flow passage. A contour of the wall open in such a way reduces back pressure and associated turbulence in the yarn deflection channel and the yarn guiding groove, whereby the yarn handling during the yarn transport by means of air flow accompaniment can be further improved.

Furthermore, the air passage is preferably arranged in the wall or formed by the wall between an entry and an exit of the yarn guiding groove and/or of the yarn deflection channel in the course direction of the curved wall section, which course direction corresponds to a transport direction of the yarn within the yarn deflection channel or the yarn guiding groove. The housing can thus be compact and have a simple design.

In general, the air flow can be an air flow produced as a result of compressed air or negative pressure. For example, the compressed air can be introduced upstream of the curved wall section in the transport direction of the yarn or the negative pressure can be introduced downstream of the curved wall section in the transport direction of yarn, into a channel that communicates with the yarn deflection channel or the yarn guiding groove. Alternatively or additionally, introduction directly into the yarn deflection channel and/or into the yarn guiding groove at a suitable point is conceivable. For this purpose, the housing can have a connection section for connecting a negative pressure source or pressure source, the connection section being in communication with the yarn deflection channel and/or the yarn guiding groove in order to supply a negative pressure or positive pressure.

The air flow to be produced can preferably be controlled in a closed-loop or open-loop manner by means of a closed-loop and/or open-loop control device that influences the negative pressure or the positive pressure. Thus, in a suitable way, the yarn strength can be influenced or a defined yarn strength of the yarn can be taken into consideration in the accompanying transport of the yarn by the air flow to be produced.

According to a preferred embodiment, the yarn guiding groove forms, along the curvature, a cross-sectional shape open on one side, e.g. a V, U or W cross-sectional shape or a similar cross-sectional shape with legs tapering or converging towards each other in the direction of the one-side open end of the cross-sectional shape. Such a cross-sectional shape promotes lateral guidance of the yarn guided in the yarn guiding groove. A cross-sectional shape formed with tapered legs reduces the risk of undesired slipping of the yarn out of the yarn guiding groove.

According to a preferred embodiment, the curved wall section having the yarn guiding groove has a circular-arc-like cross-section along the curvature, i.e. in a sectional plane extending transversely to the direction of curvature. "Circular-arc-like" should be understood to mean a circular arc formed with a radius, or a plurality of straight sections arranged one after the other, which follow the circular-arc-like cross-sectional shape or more preferably each form a circular arc tangent. Thus, a contact surface that is smooth or flat in the curvature course direction, in the latter design with reduced contact surface portion, can be created for the yarn, along which contact surface the yarn is to be deflected. The contact surface for the yarn should preferably be provided, in a manner of prior art, with a surface condition suitable for smooth guidance of a yarn in order to reduce effects caused by friction as much as possible.

The yarn guiding groove is preferably delimited in the direction of curvature by ends each forming a yarn passage, the groove depths of which ends, proceeding from the common groove base, are different from each other. Thus, one end of the yarn guiding groove has a smaller opening width than the opposite end. The end having the smaller opening width preferably forms a yarn entry for the yarn guiding groove, while the end having the larger opening width forms a yarn exit for the yarn guiding groove. The yarn guided in the yarn guiding groove can in particular be accompanied in a manner optimized with respect to flow in the course of guidance with air flow accompaniment.

According to another preferred embodiment, the housing has a contact section for the contacting of an end section of a yarn guiding element, which end section is open toward the yarn guiding groove and via which end section a yarn can be guided into the yarn guiding groove or out of the yarn guiding groove. The yarn to be inserted into the yarn deflection unit can therefore be reliably fed. For example, the yarn guiding element can be a yarn guiding tube, which is preferably used in the case of yarn guidance with air flow accompaniment. The yarn can thus already be guided into and/or out of the yarn deflection unit with air flow accompaniment.

Furthermore, the yarn deflection unit preferably has a retainer for retaining the open end section in at least one direction different from the guiding direction of the yarn. This enables reliable arrangement and fastening of the open end section of the yarn guiding element on the yarn deflection unit in a manner that is simple with respect to design.

According to another preferred embodiment, the yarn deflection unit has a flow guiding element, which guides an air flow directed into the yarn deflection channel toward the yarn guiding groove. The flow guiding element is preferably arranged opposite the yarn guiding groove and comprises, in the transport direction of the yarn, two ends connected to each other by means of an air-flow guiding surface, of which ends a first end is arranged closer to the yarn guiding groove than the other, second end. Thus, reliable guiding of the yarn into the yarn guiding groove can be ensured.

The flow guiding element and the retainer are particularly preferably coupled to each other or formed from one piece. The yarn deflection unit can thus have a further simplified design. For example, an end section comprising the first end of the flow guiding element can form the retainer for the end section of the yarn guiding element.

Furthermore, the flow guiding element and/or the retainer can preferably be detachably fastened to the housing, in which case in the fastened state the flow guiding element or the retainer forms a wall section of the yarn deflection channel that lies opposite the open yarn guiding groove. Further design simplification of the yarn deflection unit can thereby be achieved. Furthermore, different flow guiding elements can be provided for one and the same yarn deflection unit, by means of which flow guiding elements deflection air flows matched to the yarn characteristics can be provided for guidance into the yarn guiding groove.

According to a preferred embodiment, the housing has a housing side wall, which is connected to the curved wall section and extends transversely thereto and forms a holder for a yarn deflection roller, which, when held, forms a wall section of the yarn deflection channel which lies opposite the yarn guiding groove. This enables the integration of a yarn deflection roller, which is also advantageous for the yarn deflection and is already well known, into the yarn deflection unit and therefore the combination with the yarn deflection roller. The yarn deflection roller can preferably form part of the yarn deflection unit. For example, the yarn deflection roller can be exchangeable in the yarn deflection unit without damage. For this purpose, the holder can comprise a contact surface section for the yarn deflection roller and a fastening means for fastening the yarn deflection roller to the contact surface section. The fastening means can preferably be a passage for a screw or a screw yarn. The fastening means can alternatively be designed for another manner of interlockingly and/or frictionally fastening the yarn deflection roller to the contact surface section.

The yarn deflection unit, which can be equipped with a yarn deflection roller, promotes energy savings at a workstation of a textile machine in which such a yarn deflection unit is used. For example, by means of yarn guidance with air flow accompaniment, a freely movable yarn end from a take-up package rotationally retained in a winding device of the workstation can be reliably inserted into the yarn deflection unit and guided via the yarn deflection unit having the yarn guiding groove up to a yarn draw-off device, which follows the yarn deflection unit in the transport direction of the yarn and is interposed, in the yarn path, between the winding device and a yarn feeding device for feeding a yarn, with deflection for example at a deflection angle of less than 85°, in particular 70° or less. After the yarn end has been inserted into the yarn draw-off, the air flow accompanying the yarn guidance can be reduced or switched off in order to save energy. The further yarn transport can subsequently be taken on by the yarn draw-off device, in which case the yarn guidance can be accomplished by means of a surface of the yarn guiding roller in the course of the drawing off of the yarn from the take-up package. Such a method is particularly advantageous for connecting two yarn ends, for example in the case of winding machines in which a yarn is rewound from a yarn feeding device comprising a spinning bobbin onto a take-up package, or for piecing the take-up-side yarn end to a fiber band end, for example in the case of open-end spinning machines in which the yarn feeding device is formed by a spinning unit that spins the yarn, to which the fiber band end is fed.

Furthermore, the housing preferably has, on the side opposite the housing side wall, an air flow passage that communicates with the yarn deflection channel, the air flow passage being designed as described above for example. The air flow passage is particularly preferably formed by a protrusion, which is connected to the curved wall section and extends transversely thereto, an intermediate space for the intermediate positioning of the yarn deflection roller thus being formed. Such a width of the intermediate space is chosen that the yarn deflection roller can be positioned on the holder such that an air gap is formed between the yarn deflection roller and the protrusion. The protrusion is shorter, proceeding from the curved wall section in an extension direction parallel to the opposite housing side wall, than the opposite housing side wall. Furthermore, the protrusion is preferably formed by a circular arc segment, the width of which along the curvature is in particular between 0.3 and 5 mm. The advantageous air flow passage and an access possibility for fastening the yarn deflection roller can thereby be provided by means of a simplified design of the yarn deflection unit.

The preferred yarn deflection unit according to one of the preferred embodiments enables reliable, trouble-free deflection of a yarn at a deflection angle of less than 90°, in particular of less than 85°, more preferably of 70° or less, whereby a corresponding workstation of a textile machine can be designed with reduced installation space in the region of the yarn deflection unit. Furthermore, the smaller deflection angles result in further degrees of freedom for the yarn path and for the arrangement of yarn handling devices associated with the workstation.

BRIEF DESCRIPTION OF THE DRAWINGS

The invention is explained in greater detail below on the basis of embodiment examples shown in the drawings.

In the figures.

DESCRIPTION OF THE PREFERRED EMBODIMENTS

In the following description of embodiment examples, the same or similar reference signs are used for the elements shown in the various figures and having a similar effect, in which case the descriptions of these elements are not repeated.

Figure 1:
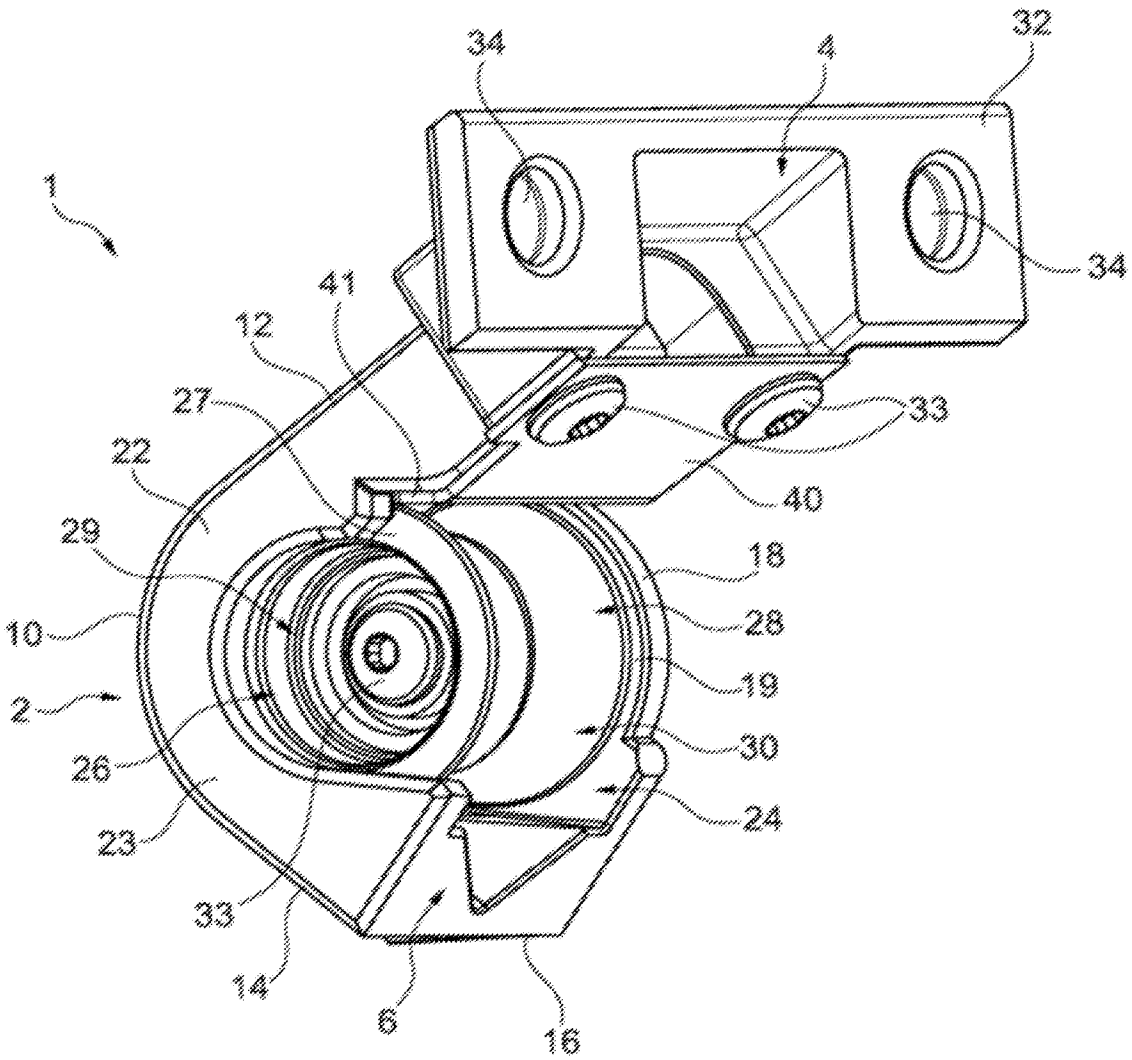
FIG. 1 shows a schematic perspective side view of a yarn deflection unit according to an embodiment example.

FIGS. 1 to 4 show a yarn deflection unit 1 according to a preferred embodiment example in different schematic views. FIG. 1 shows a schematic perspective side view, FIG. 2 a schematic side view, FIG. 3 a schematic view from below and FIG. 4 a perspective longitudinal sectional view along a section line W-W of the yarn deflection unit 1.

The yarn deflection unit 1 comprises a housing 2, which in particular is formed of an antistatic material and/or plastic-containing material, for example by means of an injection molding process. The housing 2 can be formed as a single piece or can be composed of several parts. The particularly preferred single-piece, e.g. injection-moulded design is advantageous with respect to cost and production process. The additionally or alternatively preferred antistatic design of the housing of the yarn deflection unit promotes in particular an improved, lower-friction deflection in the absence of, for example, static adhesion.

Figure 3:
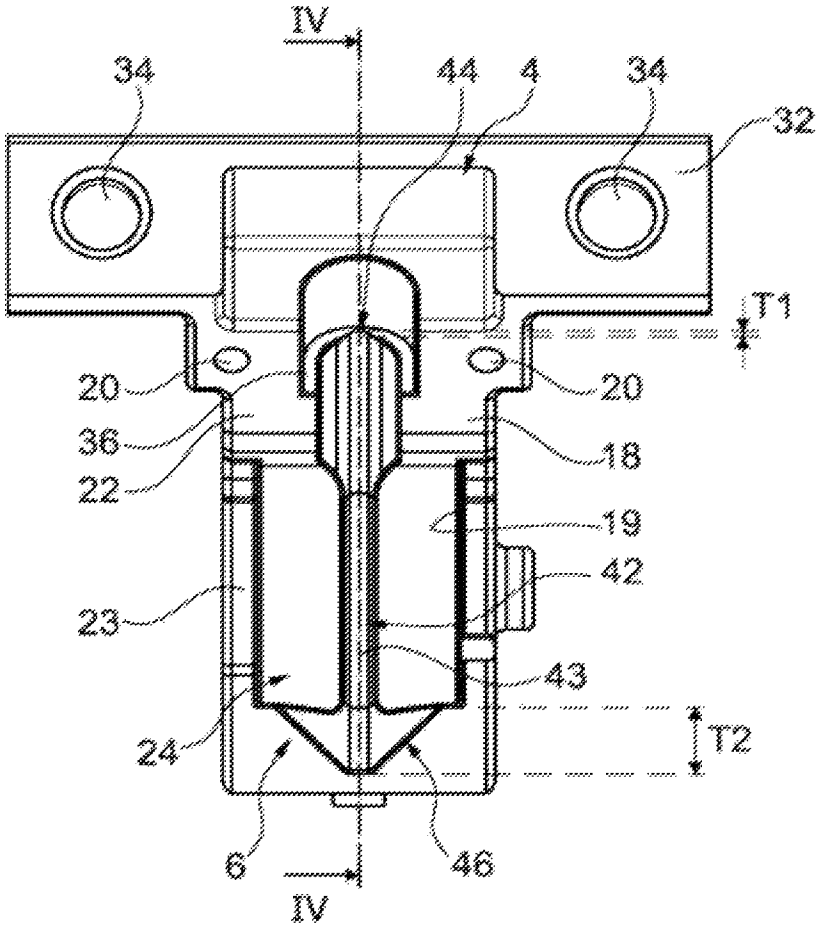
FIG. 3 shows a schematic view from below of the yarn deflection unit shown in FIG. 2.
Figure 4:
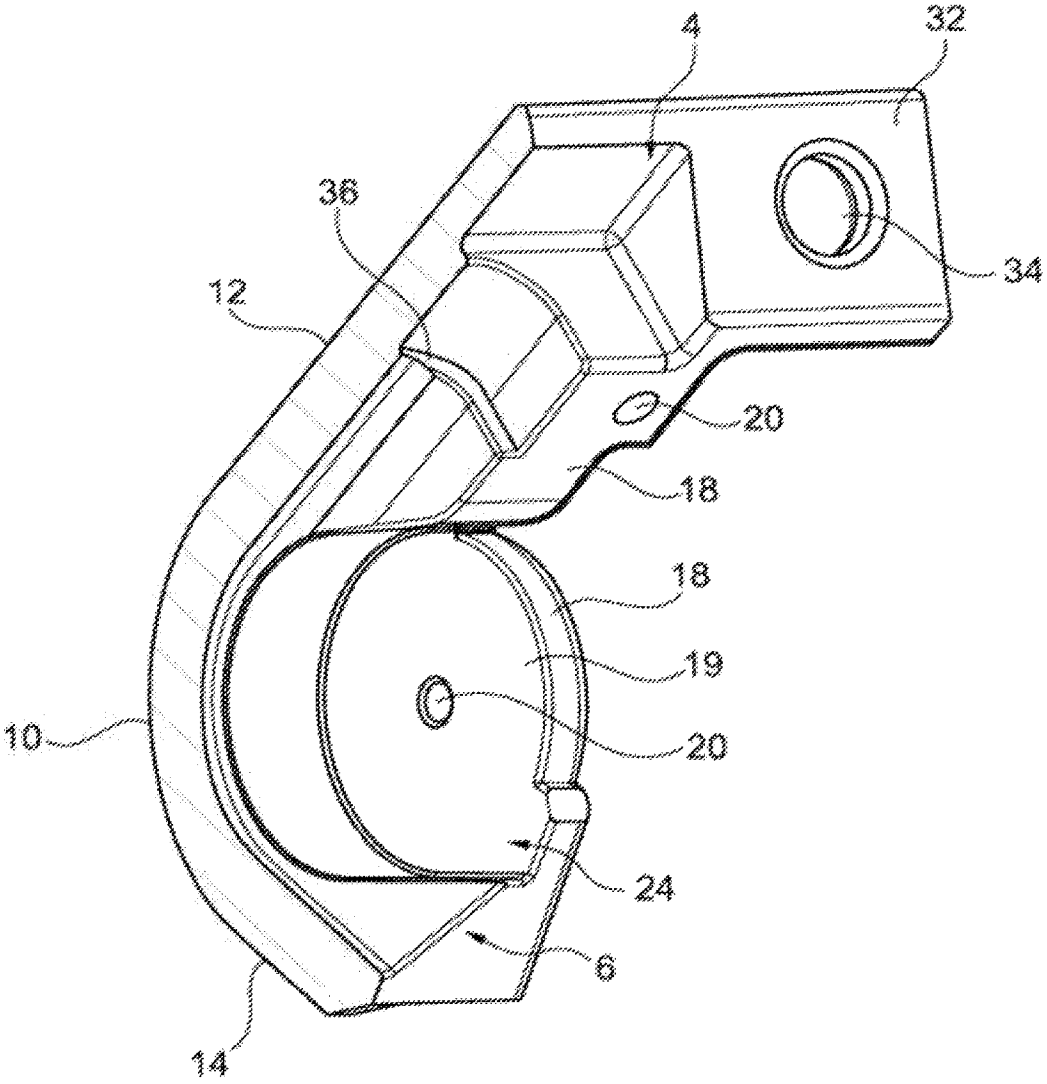
FIG. 4 shows a perspective longitudinal sectional view of the yarn deflection unit shown in FIG. 3, along the section line

The housing 2 has a housing entry 4 and a housing exit 6, which are connected to each other by means of two straight wall sections 12, 14, between which a curved wall section 10 is interposed. The curved wall section 10 is cross-sectionally formed from a circular arc having a defined radius. In this preferred embodiment example, the curved wall section 10 is bordered at ends thereof by the two straight wall sections 12, 14. The straight wall sections 12, 14 and the curved wall section 10 are approximately U-, V- or W-shaped in a cross-section along a section line that extends transversely to an arrangement direction of the wall sections 10, 12, 14, with a housing roof 16 and two housing side walls 18, 22 lying opposite each other and extending out from the housing roof 16, an intermediate space 24 thus being formed, which should be understood as a housing channel. The ends of the mutually opposite housing side walls 18, 22 delimit an open housing side formed in the cross-sectional plane. The housing channel or intermediate space 24 formed between the housing side walls 18, 22 lying opposite each other is part of a yarn deflection channel 30 (FIG. 3).

Figure 2:
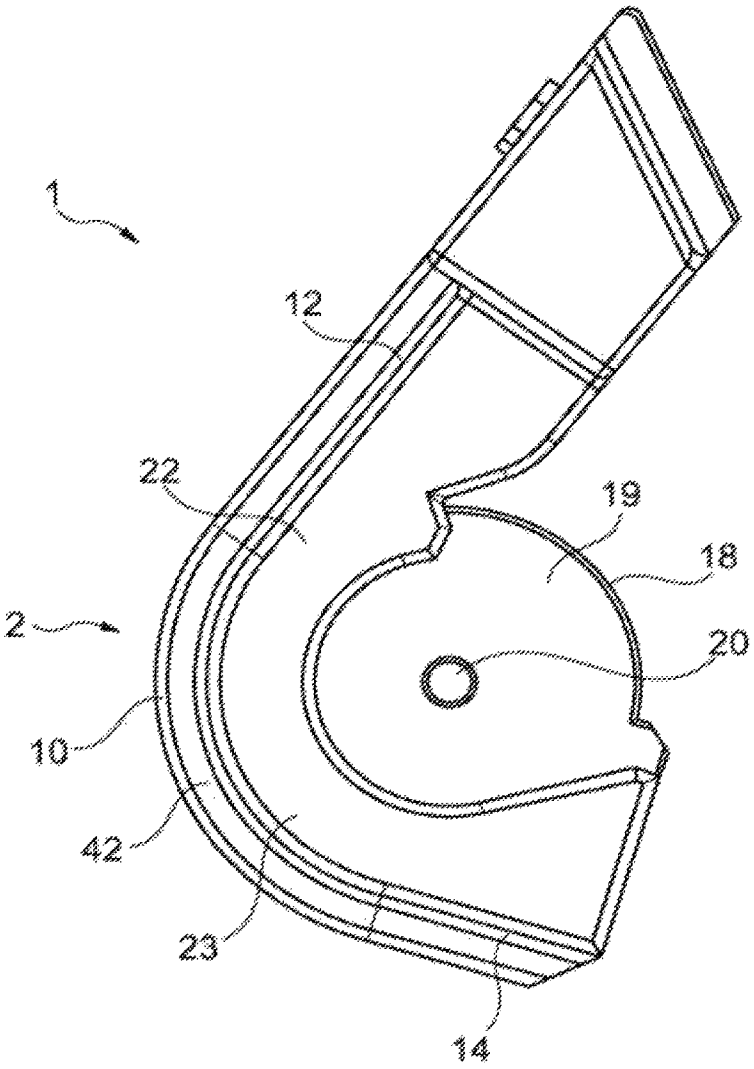
FIG. 2 shows a schematic side view of the yarn deflection unit shown in FIG. 1, without the yarn deflection roller and the retainer.

Of the two housing side walls 18, 22, one housing side wall 18 forms, in one section, a holder 19 for holding and rotatably supporting a yarn deflection roller 26. For this purpose, as shown in FIG. 2, the holder 19 as shoulder disc is provided with a fastening opening 20 for rotatably supporting the yarn deflection roller 26. The yarn deflection roller 26 is usually, in this embodiment example, formed with a V-shaped yarn guiding channel 28, which forms the yarn deflection channel 30 together with the housing channel 24 when the yarn deflection roller 26 is held on the holder 19.

The other of the two housing side walls 18, 22 is formed as a protrusion 23 in one section, which protrusion 23 extends parallel to the holder 19 from the housing roof 16 but with a shorter extension length than the holder 19. The protrusion 23 has such an extension length that a circular-arc-segment-like edge region 27 of the yarn deflection roller 26 facing the protrusion 23 is at least partially covered by the protrusion 23 when the yarn deflection roller 26 is held. The edge region 27 delimits a fastening passage 29 in the yarn deflection roller 26, through which fastening passage 29 the yarn deflection roller 26 can be fastened to the holder 19 by means of a fastening screw 33 in this preferred embodiment example. The shorter design of the protrusion 23 therefore enables easy fastening of the yarn deflection roller 26 to the holder 19 through the fastening passage 29.

The holder 19 has such a distance from the protrusion 23 along the housing channel 24 formed in between that the yarn deflection roller 26 can be fastened to the holder 19 in an interposed position such that an air gap is formed between the protrusion 23 and the edge region 27. Via the air gap, a portion of an air flow introduced into the yarn deflection channel 30 can escape at the side of the housing 2 in a defined manner, for example in dependence on the selected size of the air gap. Thus, when there is an air flow in the yarn deflection channel 30, air flow turbulence and undesired back pressure, which have a disadvantageous effect in the course of yarn guidance deflected via the yarn deflection unit 1 particularly when a yarn end is guided through the yarn deflection channel 30, can be suppressed. The size of the air gap can additionally or alternatively be influenced in dependence on the dimension of the yarn deflection roller 26. Furthermore, the air gap promotes easier insertion of the yarn deflection roller into the housing channel 24 with play.

FIGS. 1 to 4 also show a fastening section 32 arranged on the housing 2, having fastening passages 34 for fastening the housing 2 to or in the region of a workstation of a textile machine, which workstation is not shown. In this preferred embodiment example, the fastening section 32 forms the housing entry 4.

As shown in detail in FIGS. 1 and 3 to 5, the housing 2 also has a fastening opening 20 for fastening a retainer 40, which is designed to cover an open section of the housing channel 24 and to retain an open end section 52 of a yarn guiding element 50, which open end section 52 is inserted into the housing entry 4. The open end section 50 comes in contact, at an end thereof, with a contact section 36 formed by the housing 2. For this purpose, the retainer 40 is fastened to the housing side walls 18, 22 of the housing 2 in the region of the straight wall section 12 by means of fastening screws 33, which engage in the respective associated fastening openings 20.

Figure 5:
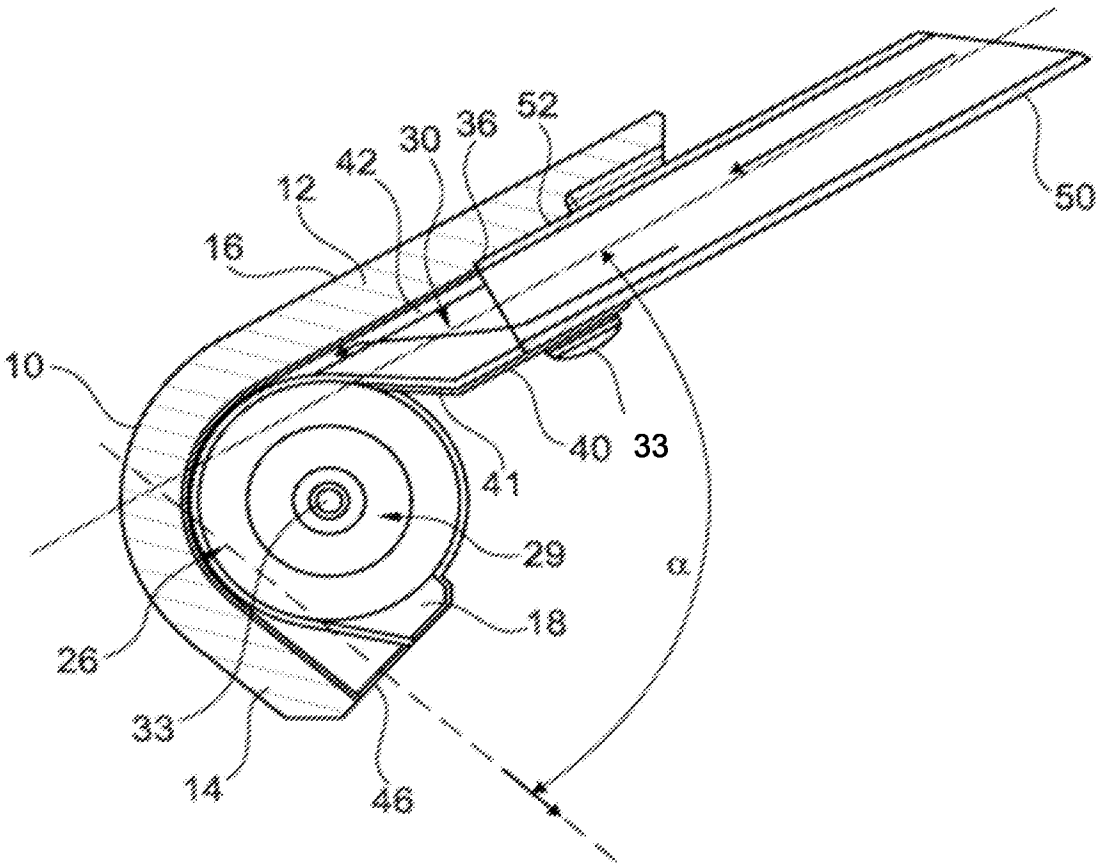
FIG. 5 shows a schematic sectional view of the yarn deflection unit shown in FIG. 1.

The retainer 40 has a contour corresponding to the edge of the housing side walls 18, 22, whereby the retainer 40 can be laid or arranged on respective end edges of the housing side walls 18, 22. As shown in FIG. 5, the contour is designed in such a way that an air flow introduced into the yarn deflection channel 30 via the yarn guiding element 50 is deflected toward the housing roof 16. For this purpose, the retainer 40 has a flow guiding element 41, which is coupled to a retaining section of the retainer 40, which retaining section is provided for retaining the open end section 52. In an alternatively preferred way, the flow guiding element 41 can be provided as an individual component independent of the retainer 40. By means of the flow guiding element 41, an air flow introduced into the yarn deflection unit can be expediently deflected. The form of the flow guiding element 41 can be arranged and designed so as to meet the requirements for the expedient deflection of an air flow.

In the region of the housing roof 16, a yarn guiding groove 42 open toward the yarn deflection channel 30 is formed for the guiding deflection of a yarn inserted into the yarn deflection unit 1. In this preferred embodiment example, the yarn guiding groove 42 extends from the entry-side straight wall section 12 via the curved wall section 10 to the following exit-side straight wall section 14. The yarn guiding groove 42 has, in this preferred embodiment example, a U-shaped cross-section in a sectional plane extending transversely to the direction of curvature. Alternatively, the yarn guiding groove 42 can have any other cross-sectional shape that is suitable for guiding a yarn through the yarn deflection unit 1 in a deflecting manner. For example, the cross-sectional shape can have a V, W or similar shape as described above as examples, such as two legs tapering or converging towards each other in the direction of an open end of the cross-sectional shape, the two legs being joined together on a side opposite the open end. Such a shape is also known as a bulging crucible shape, for example.

In this preferred embodiment example, the yarn guiding groove 42 is formed as a recess in the housing roof 16 on a wall inner side facing the yarn deflection channel 30. Alternatively, the yarn guiding groove 42 can preferably be designed as a channel arranged on the inner side of the housing roof 16 and open toward the yarn deflection channel 30, said channel having two mutually opposite channel walls protruding from the inner side of the housing roof 16, in which case a section of the wall inner side of the housing roof 16 that is enclosed or interposed between the protruding channel walls forms the channel base of the channel thus formed.

The arrangement of the yarn guiding groove 42 opposite the flow guiding element 41, which arrangement is shown in FIG. 5, promotes the guidance of a yarn, which has been inserted into the yarn deflection unit 1, into the yarn guiding groove 42 with air accompaniment. The yarn can therefore be reliably guided into the yarn guiding groove 42 and along the yarn guiding groove 42 out of the yarn deflection unit 1.

The yarn guiding groove 42 is terminally delimited by ends 44, 46 forming respective yarn passages, the groove depths T1, T2 of which ends 44, 46, proceeding from the common groove base 43 of the yarn guiding groove 42, are different from each other. In other words, an open end 44 of the yarn guiding groove 42 has a smaller opening width than the other open end 46 of the yarn guiding groove 42. In this preferred embodiment example, the open end 44 having the smaller opening width forms an end entry for the yarn guiding groove 42, while the open end 46 having the larger opening width forms an end exit for the yarn guiding groove 42. The yarn to be guided in the yarn guiding groove 42 can thus be accompanied by means of an air flow in a manner optimised with respect to flow.

By means of the yarn deflection unit 1 described above as an example, a yarn can be deflected by means of only one deflection means at a workstation of a textile machine at a deflection angle $\alpha$ of less than 90° or smaller deflection angles $\alpha$ of less than 85° or of 70°, as shown in FIG. 5, or less than 70°, without having to accept disadvantageous effects on the deflected yarn. In other words, according to a preferred embodiment example, a yarn path at a workstation of a textile machine, such as a winding machine or an open-end spinning machine, which comprises a winding device for winding a take-up package, a yarn feeding device for feeding a yarn and a yarn draw-off device, which is interposed between the winding device and the yarn feeding device in the yarn path, for drawing off a yarn, can be readily provided with a deflection angle $\alpha$ of less than 90° or a much smaller deflection angle $\alpha$ of 70° or less at the arrangement location of the yarn deflection unit, for example between the winding device and the yarn draw-off device. Thus, installation space can be spared at the workstation. Furthermore, numerous new possibilities with respect to the arrangement of yarn handling components at the workstation result.

In addition, energy can be saved, for example, in the course of a method for operating the workstation according to a preferred embodiment example. The yarn deflection unit interposed between the winding device and the yarn draw-off device, according to one of the embodiment examples described above, enables the transporting of a take-up-side yarn end with air flow accompaniment from a take-up package rotatably retained in the winding device to the yarn draw-off device after a yarn interruption, such as a yarn cut or a yarn break, the transported yarn end being inserted into the yarn draw-off device and the air flow used to accompany the yarn being able to be reduced or switched off when or after the yarn is inserted into the yarn draw-off device, because the further transport of the yarn can be taken on by the yarn draw-off device.

The described embodiment examples shown in the figures are only selected by way of example. Different embodiment examples can be combined with one another completely or with regard to individual features. Also, an embodiment example can be supplemented by features of a further embodiment example.

If an embodiment example has an "and/or" link between a first feature and a second feature, this should be understood to mean that the embodiment example, according to one embodiment type, comprises both the first feature and the second feature and, according to a further embodiment type, comprises either only the first feature or only the second feature.

LIST OF REFERENCE SIGNS

1 Yarn deflection unit
2 Housing
4 Housing entry
6 Housing exit
10 Curved wall section
12, 14 Straight wall section
16 Housing roof
18, 22 Housing side wall
19 Holder
20 Fastening opening
23 Protrusion
24 Housing channel
26 Yarn deflection roller
27 Edge region
28 Yarn guiding channel
29 Fastening passage
30 Yarn deflection channel
32 Fastening section
34 Fastening passage
36 Contact section
40 Retainer
41 Flow guiding element
42 Yarn guiding groove
43 Groove base
44, 46 Open end of the yarn guiding groove
50 Yarn guiding element
52 Open end section
T1, T2 Groove depth
α Deflection angle It will therefore be readily understood by those persons skilled in the art that the present invention is susceptible of broad utility and application. Many embodiments and adaptations of the present invention other than those herein described, as well as many variations, modifications and equivalent arrangements, will be apparent from or reasonably suggested by the present invention and the foregoing description thereof, without departing from the substance or scope of the present invention. Accordingly, while the present invention has been described herein in detail in relation to its preferred embodiment, it is to be understood that this disclosure is only illustrative and exemplary of the present invention and is made merely for purposes of providing a full and enabling disclosure of the invention. The foregoing disclosure is not intended or to be construed to limit the present invention or otherwise to exclude any such other embodiments, adaptations, variations, modifications and equivalent arrangements.

What is claimed is:

1. A yarn deflection unit for a textile machine, having a housing comprising a curved wall section for forming a radially outer wall section of a curved yarn deflection channel, characterised in that the curved wall section has a yarn guiding groove extending along the curvature for receiving and guiding a yarn and that the yarn guiding groove is delimited in the curvature direction by ends forming respective yarn passages, the groove depths of which ends, proceeding from the common groove base, are different from each other.

2. The yarn deflection unit according to claim 1, characterised in that the yarn guiding groove forms a V- or U-shaped cross-sectional shape along the curvature.

3. The yarn deflection unit according to claim 1 characterised in that the curved wall section having the yarn guiding groove has a circular-arc-like cross-section along the curvature.

4. The yarn deflection unit according to claim 1, characterised in that the housing has a contact section for the contacting of an end section of a yarn guiding element, which end section is open toward the yarn guiding groove and via which end section a yarn can be guided into the yarn guiding groove or out of the yarn guiding groove.

5. The yarn deflection unit according to claim 1, characterised in that the yarn deflection unit has a flow guiding element, which guides an air flow directed into the yarn deflection channel toward the yarn guiding groove.

6. The yarn deflection unit according to claim 5, characterised in that the flow guiding element and a retainer are coupled to each other or are formed from one piece.

7. The yarn deflection unit according to claim 6, characterised in that the flow guiding element and/or the retainer can be detachably fastened to the housing, wherein in the fastened state the flow guiding element or the retainer forms a wall section of the yarn deflection channel which lies opposite the open yarn guiding groove.

8. A yarn deflection unit for a textile machine, having a housing comprising a curved wall section for forming a radially outer wall section of a curved yarn deflection channel, characterised in that the curved wall section has a yarn guiding groove extending along the curvature for receiving and guiding a yarn and the housing has a contact section for the contacting of an end section of a yarn guiding element, which end section is open toward the yarn guiding groove and via which end section a yarn can be guided into the yarn guiding groove or out of the yarn guiding groove and the yarn deflection unit has a retainer for retaining the open end section in at least one direction different from the guiding direction of the yarn.

9. A yarn deflection unit for a textile machine, having a housing comprising a curved wall section for forming a radially outer wall section of a curved yarn deflection channel, characterised in that the curved wall section has a yarn guiding groove extending along the curvature for receiving and guiding a yarn The yarn deflection unit according to claim 1, characterised in that and the housing has a housing side wall, which is connected to the curved wall section and extends transversely thereto and forms a holder for a yarn deflection roller, which, when held, forms a wall section of the yarn deflection channel which lies opposite yarn guiding groove.

10. The yarn deflection unit according to claim 9, characterised in that the housing has, on the side opposite the housing side wall, an air flow passage that communicates with the yarn deflection channel.

11. The yarn deflection unit according to claim 10, characterised in that the air flow passage is formed by a protrusion, which is connected to the curved wall section and extends transversely thereto, an intermediate space for the intermediate positioning of the yarn deflection roller thus being formed, wherein such a width of the intermediate space is chosen that the yarn deflection roller can be positioned on the holder such that an air gap is formed between the yarn deflection roller and the protrusion, the protrusion being shorter, proceeding from the curved wall section in an extension direction parallel to the opposite housing side wall, than the opposite housing side wall.

12. The yarn deflection unit according to claim 11, characterised in that the protrusion is formed by a circular arc segment.

13. The yarn deflection unit according to claim 12, wherein width of the circular arc segment has a width along the extension direction between 0.3 mm and 5 mm.

14. A method for operating a workstation of a textile machine, having a winding device for winding a take-up package, a yarn feeding device for feeding a yarn and a yarn draw- off device, which is interposed between the winding device and the yarn feeding device in the yarn path, for drawing off a yarn from the take-up package;

characterised in that a yarn deflection unit for a textile machine, having a housing comprising a curved wall section for forming a radially outer wall section of a curved yarn deflection channel, the curved wall section having a yarn guiding groove extending along the curvature for receiving and guiding a yarn, and wherein the yarn defection unit is arranged interposed between the winding device and the yarn draw-off device in the yarn path, take-up-package-side yarn end is transported from a take-up package, which is rotatably retained in the winding device, via the yarn deflection unit to the yarn draw-off device with air flow accompaniment after a yarn interruption, and the yarn end is inserted into the yarn draw-off device, wherein an air flow used to accompany the yarn is reduced or switched off when or after the yarn is inserted into the yarn draw-off device.

15. A workstation of a textile machine, having a winding device for winding a take- up package, a yarn feeding device for feeding a yarn and a yarn draw-off device, which is interposed between the winding device and the yarn feeding device in the yarn path, for drawing off a yarn;

characterised in that a yarn deflection unit for a textile machine, having a housing comprising a curved wall section for forming a radially outer wall section of a curved yarn deflection channel, the curved wall section having a yarn guiding groove extending along the curvature for receiving and guiding a yarn, and wherein the yarn defection unit is arranged interposed between the winding device and the yarn draw-off device in the yarn path, is arranged, a deflection angle ($\alpha$) provided by the yarn deflection unit being less than 85°.

16. The workstation according to claim 15, wherein the deflection angle ($\alpha$) provided by the yarn deflection unit being 70° or less.

* * * * *